US007240521B2

(12) United States Patent
Matsuda

(10) Patent No.: US 7,240,521 B2
(45) Date of Patent: Jul. 10, 2007

(54) KNITTED-IN SLIDE FASTENER

(75) Inventor: Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/384,902

(22) Filed: Mar. 20, 2006

(65) Prior Publication Data

US 2006/0213235 A1 Sep. 28, 2006

(30) Foreign Application Priority Data

Mar. 25, 2005 (JP) ..... 2005-088482

(51) Int. Cl.
*D04B 21/20* (2006.01)

(52) U.S. Cl. ..... 66/193; 66/195

(58) Field of Classification Search ..... 66/195, 66/190, 192, 193
See application file for complete search history.

(56) References Cited

U.S. PATENT DOCUMENTS

| | | | | |
|---|---|---|---|---|
| 3,864,945 | A | 2/1975 | Fröhlich | |
| 5,502,986 | A * | 4/1996 | Matsuda et al. | 66/193 |
| 5,540,064 | A * | 7/1996 | Matsuda et al. | 66/193 |
| 5,615,563 | A * | 4/1997 | Matsuda et al. | 66/193 |
| 5,685,177 | A * | 11/1997 | Matsuda et al. | 66/193 |
| 5,794,460 | A * | 8/1998 | Matsuda et al. | 66/193 |
| 5,857,359 | A * | 1/1999 | Matsuda et al. | 66/193 |
| 6,006,552 | A * | 12/1999 | Matsuda et al. | 66/193 |
| 6,148,643 | A * | 11/2000 | Matsuda et al. | 66/193 |
| 6,651,296 | B2 * | 11/2003 | Matsuda | 66/193 |
| 6,971,253 | B2 * | 12/2005 | Matsuda et al. | 66/193 |
| 2005/0178161 | A1 * | 8/2005 | Matsuda et al. | 66/195 |

FOREIGN PATENT DOCUMENTS

| | | |
|---|---|---|
| CH | 551770 | 7/1974 |
| EP | 0743025 | 11/1996 |
| JP | 8-308613 | 11/1996 |
| JP | 3338997 | 8/2002 |

* cited by examiner

*Primary Examiner*—Danny Worrell
(74) *Attorney, Agent, or Firm*—Everest Intellectual Property Law Group; Michael S. Leonard

(57) ABSTRACT

A knitted-in slide fastener in which a continuous fastener element row can be mounted stably in its dimensional meaning and firmly while breaking of a needle is prevented, so as to secure a smooth engagement of elements, wherein the continuous fastener element row is fixed and knitted-in by a fixing chain knitting yarn at the same time when a fastener tape is knitted, the fixing chain knitting yarn for the elements is knitted into plural wales of a fastener element attaching portion on one side edge of the fastener tape, warp knitting yarns to be knitted for reinforcement are entangled with a needle loop formed by a constituent yarn of at least one of wales in a foundation structure adjoining the plural wales through their needle loops but not entangled with a needle loop of the fixing chain knitting yarn through their needle loops.

2 Claims, 7 Drawing Sheets

KNITTED-IN SLIDE FASTENER

BACKGROUND OF THE INVENTION

1. Field of the Invention

The present invention relates to a knitted-in slide fastener in which a continuous fastener element row is knitted continuously into an element attaching portion of a side edge of a fastener tape with being fixed by a fixing warp knitting yarn, at the same time when the fastener tape is knitted with a warp knitting structure.

2. Description of the Related Art

Conventionally, a number of knitted-in slide fasteners have been proposed. According to Japanese Patent Application Laid-Open No. 8-308613, a foundation structure of a fastener tape is constituted of a chain knitting yarn, a tricot yarn or two needle stitch yarn and a weft in-laid yarn, and each element of a fastener element row knitted into a side edge in a longitudinal direction of the fastener tape is fixed with a sinker loop of a fixing chain knitting yarn. Then, a needle loop of one warp knitting yarn of the chain knitting yarn and tricot knitting yarn or two needle stitch yarn constituting the foundation structure and a needle loop of the fixing chain knitting yarn are entangled with each other to form a knitting structure.

Because the foundation structure is constituted of the weft in-laid yarn and two kinds of the warp knitting yarns of three warp knitting yarns, an elaborate and massive structure is provided so that the fastener element row is mounted strongly, and the fastener element row is stabilized in a dimensional meaning so as to eliminate an error in pitch. Further, an appropriate resistance is provided against bending which pushes the fastener face upwards, so that it prevents breaking of engagement due to the bending during use of the fastener.

In a knitted-in slide fastener according to Japanese Patent No. 3338997, a needle loop of the chain knitting yarn which constitutes the foundation structure is entangled with a needle loop of the fixing chain knitting yarn, although the foundation structure of the fastener tape is constituted of the chain knitting yarn, tricot knitting yarn or two-needle stitch yarn, and weft in-laid yarn in the same manner as in the aforementioned Japanese Patent Application Laid-Open No. 8-308613. With such a configuration, the knitted fabric of the continuous fastener element row attaching portion is formed elaborately, and elongation/contraction of the fabric is almost eliminated, so that the coil-like fastener element row to be mounted on the attaching portion can be fixed dimensionally in a stable condition, thereby always maintaining a function as the fastener sufficiently.

In the knitted slide fasteners disclosed in the aforementioned documents of Japanese Patent Application Laid-Open No. 8-308613 and Japanese Patent No. 3338997, as described above, the needle loop of the fixing chain knitting yarn is entangled with the needle loop of the warp knitting yarn of the foundation structure. This means that respective needle loops of two or more warp knitting yarns including the fixing chain knitting yarn are formed by a single needle. By the way, as the fixing chain knitting yarn, generally, an extremely thick yarn is used as compared with other warp knitting yarns because the fixing chain knitting yarn strengthens the fixing of the elements and intensifies the hardness of the structure. The fixing chain knitting yarn has a double size as compared with that of the warp knitting yarn which constitutes a general foundation structure.

A warp yarn having an ordinary size or a thin warp knitting yarn is capable of forming two or more needle loops with a single needle. However, if it is intended to form two or more needle loops at the same time with an extremely thick fixing warp knitting yarn and a warp knitting yarn having the ordinary size by using a single needle, the needle is applied with an excessive load, whereby often being broken, or the hook portion of the needle becomes relatively small to generate a drop stitch, thereby worsening yield considerably.

On the other hand, as mentioned in the aforementioned documents of Japanese Patent Application Laid-Open No. 8-308613 and Japanese Patent No. 3338997, this kind of the knitted-in slide fastener has been demanded to be so constructed that the structure is formed elaborately and thickly to fix the fastener element row firmly, the fastener element row is dimensionally stabilized to eliminate a pitch error. Further, it is required that an appropriate resistance against a bending to push the fastener surface upward is secured to prevent breaking of engagement of elements due to bending during usage of the fastener.

SUMMARY OF THE INVENTION

Accordingly, an object of the invention is to provide a knitted-in slide fastener in which a fastener element row can be mounted in a stable condition and firmly in a dimensional meaning, while breaking of a needle is prevented, so as to secure a smooth engagement of the elements.

To achieve the above object, according to the invention, there is provided a knitted-in slide fastener in which at the same time when the fastener tape is knitted, a continuous fastener element row is fixed and knitted, by a fixing chain knitting yarn, into a fastener element attaching portion of a side edge in a longitudinal direction of a warp knitted fastener tape knitted with a foundation structure composed of warp knitting yarns, the slide fastener further including: warp knitting yarns entangled with a needle loop of a foundation warp knitting yarn that forms at least one of wales of a foundation structure adjacent to a wale, the wale formed in a fastener element attaching portion by the fixing chain knitting yarn, through a needle loop, while not entangled with a needle loop of the fixing chain knitting yarn through a needle loop.

According to a preferred embodiment, the warp knitting yarns not entangled with the needle loop of the fixing chain knitting yarn are inserted through a sinker loop of the fixing chain knitting yarn on the wales adjacent to the wales formed by being entangled with a needle loop of the foundation warp knitting yarn that constitutes the foundation structure through a needle loop, and are wound around the needle loop and folded back. Further, the needle loop of the warp knitting yarn may be entangled with a needle loop of a warp knitting yarn which constitutes the foundation structure of two wales adjoining across a wale formed by the fixing chain knitting yarn.

Although a needle loop of the warp knitting yarn is entangled with a needle loop of the foundation warp knitting yarn of at least one of wales of the foundation structure adjacent to a wale formed by the fixing chain knitting yarn, it is never entangled with the needle loop of the fixing chain knitting yarn. Usually, the warp knitting yarn is inserted into a sinker loop striding across a course of the fixing chain knitting yarn, wound around the needle loop of the fixing chain knitting yarn, and folded back. Alternatively, every needle loop of the warp knitting yarn is entangled with the needle loop of the foundation warp knitting yarn in the foundation structure of two wales adjoining across the fixing chain knitting yarn but not entangled with the needle loop of the fixing chain knitting yarn.

As a consequence, every needle loops of the fixing chain knitting yarn and the needle loop of the warp knitting yarn are not formed with the same needle at the same time so as to block the needle of the fixing chain knitting yarn from being applied with an excessive load. Because the needle loop is formed securely, the fastener tape portion of the element attaching portion is formed elaborately, and the fastener element row is fixed dimensionally in a stable condition and firmly, so that a smooth engagement of the fastener elements is secured, thereby preventing breaking of the engagement of the elements.

DESCRIPTION OF THE PREFERRED EMBODIMENTS

Hereinafter, typical embodiments of the present invention will be described in detail with reference to the accompanying drawings.

In embodiments described below, a foundation chain knitting yarn 12 which is a composition yarn of a foundation structure is knitted into a wale W1 of the first row formed at the outermost of an element attaching portion 1*a* of a fastener tape 1 and three wales W4 to W6 in a fastener tape main body 1*b* adjacent to the element attaching portion 1*a*, but no foundation chain knitting yarn 12 is knitted in other tape side edge and other wales W2, W3 and W7 to Wn. This aims at forming the fastener tape main body 1*b* more flexibly, and of course, the foundation chain knitting yarn 12 can be knitted into all wales W1 and W4 to Wn except the second and third wales W2, W3 where a fixing chain knitting yarn 14 is knitted in.

Figure 1:
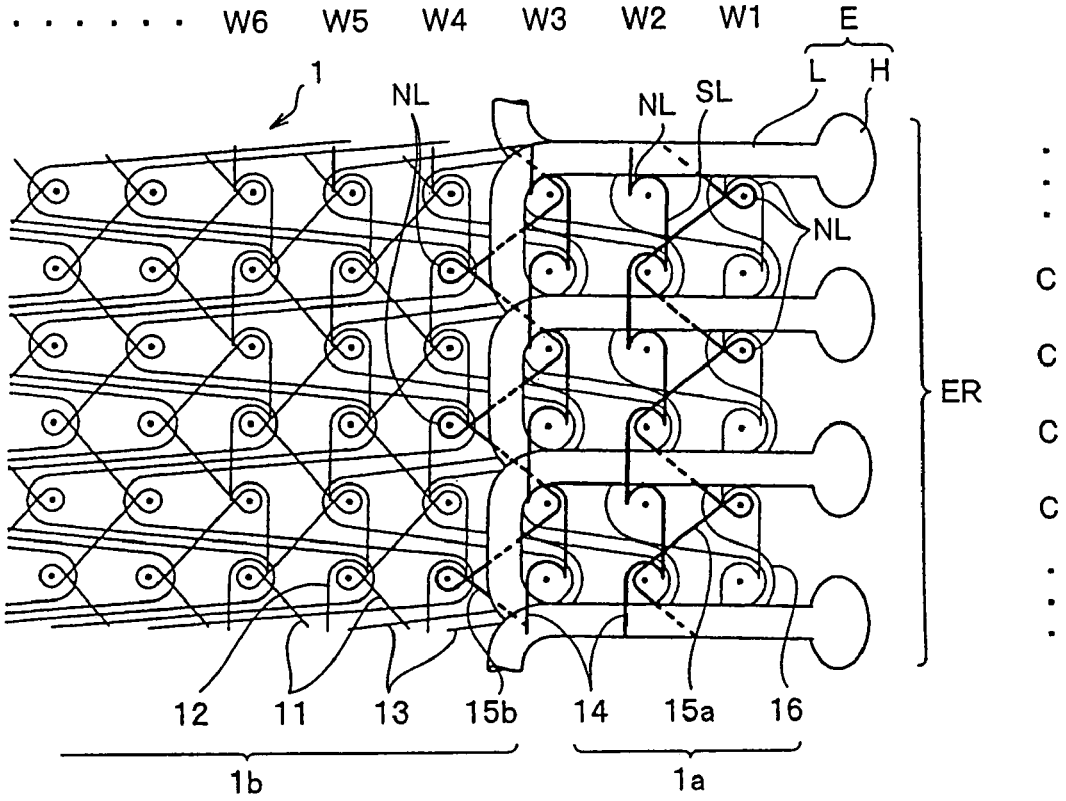
FIG. 1 is a structure view showing an entire warp knitting structure of a warp knitted-in slide fastener according to a first embodiment of the present invention.
Figure 2:
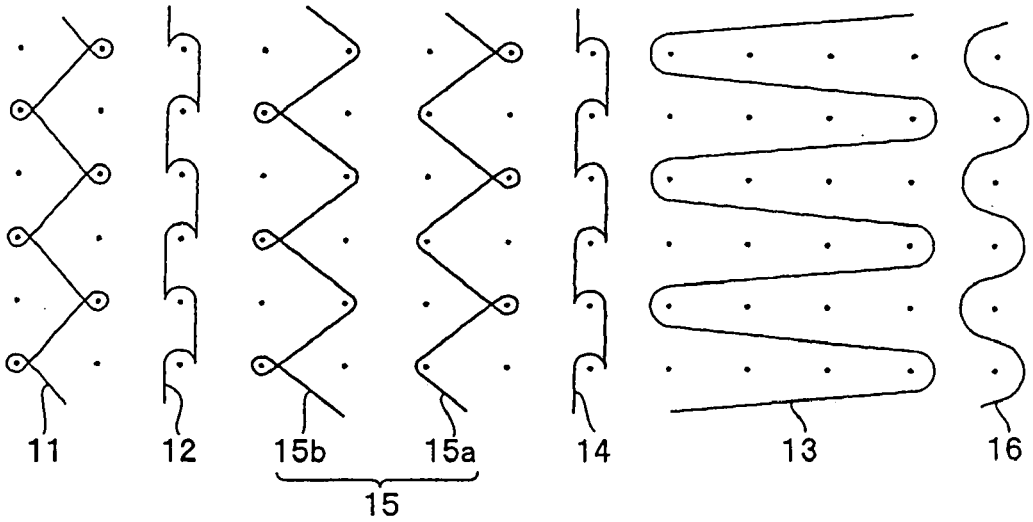
FIG. 2 is a warp knitting structure view of respective knitting yarns.
Figure 3:
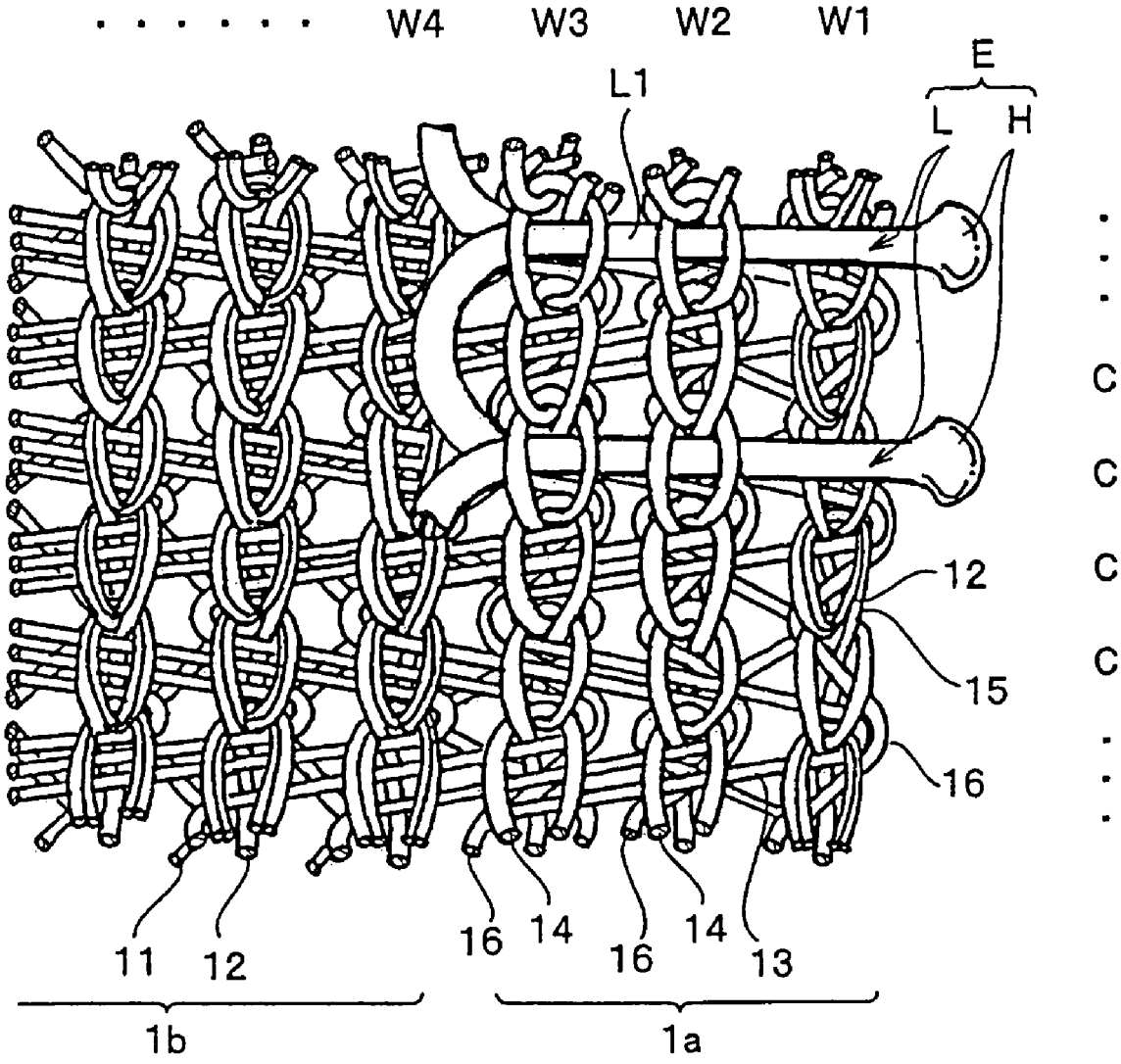
FIG. 3 is a partial plan view schematically showing the slide fastener.

FIG. 1 is a warp knitting structure view of a knitted-in slide fastener according to a first embodiment of the present invention. FIG. 2 is a knitting structure view of respective composition warp knitting yarns of the slide fastener, and FIG. 3 is a partial plan view schematically showing the structure of the slide fastener.

The knitted-in slide fastener 1 is knitted by a general warp knitting machine having a single row of needle bed, and comprises a fastener tape 1 obtained by warp knitting and a continuous fastener element row ER molded by synthetic resin monofilament, the fastener element row being knitted into an element attaching portion 1*a* formed at one side edge in a longitudinal direction of the fastener tape 1 at the same time when the fastener tape 1 is knitted. As shown in FIG. 2, the foundation structure of the fastener tape 1 is knitted with a foundation tricot knitting yarn 11 (1-2/1-0), a foundation chain knitting yarn (1-0/0-1) and a foundation weft in-laid yarn 13 (0-0/4-4). Then, the three wales W1 to W3 of the side edge portion in the longitudinal direction of the fastener tape 1 constitute the above-mentioned element attaching portion 2.

According to this embodiment, monofilament, which is a composition material of a continuous coil-like fastener element row ER, is reciprocated laterally within the same course of every other course C and knitted into the fastener tape 1 so as to form respective fastener elements E in succession. The second wale W2 and the third wale W3 from the outermost side edge of the fastener tape 1 are formed by the fixing chain knitting yarn 14 (1-0/0-1), the foundation weft in-laid yarn 13 and a reinforcement warp knitting yarn 15 described later. In the fastener element E, as shown in FIG. 3, its upper and lower leg portions L1, L2 are inserted between a needle loop NL and a sinker loop SL of the fixing chain knitting yarn 14 which forms the two wales W2 and W3, the top face of the upper leg portion L1 is knitted in so as to be pressed by the needle loop NL of the fixing chain knitting yarn 14, and the fastener element E is fixed to the fastener tape 1 in succession.

According to this embodiment, the foundation tricot knitting yarn 11 and the foundation chain knitting yarn 12 which constitute the foundation structure are not knitted into the two rows of the wales W2 and W3 in which the fixing chain knitting yarn 14 is disposed. The wale W1 formed at the outermost side of the element attaching portion 1*a* constitutes an ear portion of the fastener tape 1, but this ear portion is knitted with the foundation chain knitting yarn 12, the foundation weft in-laid yarn 13, the warp knitting yarn 15 and a warp in-laid yarn 16 (0-0/1-1). Here, the warp in-laid yarn 16 aims at stabilizing the shape of the ear portion and securing its strength. In the indicated example, the warp in-laid yarn 16 is inserted into all the wales W1 to W3 in order to form the element attaching portion 1*a* elaborately.

As the reinforcement warp knitting yarn 15 of this embodiment, two warp knitting yarns are used as shown in FIGS. 1 and 2, and the knitting structures of the first and second warp knitting yarns 15*a*, 15*b* are 1-2/0-0 and 2-2/1-0. According to these knitting structures, the first warp knitting yarn 15*a* is knitted in between the wale W2 of the second row from the outside formed with the fixing chain knitting yarn 14 and the outermost wale W1 which constitutes the ear portion adjacent to the outside of the wale W2, and the second warp knitting yarn 15*b* is knitted in between the wale W3 of the third row and the wale W4 of the fourth row adjacent to the side of the tape main body 1*b*.

As for the first warp knitting yarn 15*a* knitted in between the wale W1 of the first row and the wale W2 of the second row, as evident from FIGS. 1 to 3, the needle loop NL of the first warp knitting yarn 15*a* is entangled with the needle loop NL of the foundation chain knitting yarn 12 in the wale W1 of the first row. However, in case of the wale W2 of the second row, after the first warp knitting yarn 15*a* is inserted in between the needle loop NL and the sinker loop SL of the fixing chain knitting yarn 14, the first warp knitting yarn 15*a* is wound around the needle loop NL of the fixing chain knitting yarn 14 and inverted. Here, the first warp knitting yarn 15*a* does not form a needle loop NL, and is not entangled with the needle loop NL of the fixing chain knitting yarn 12 by its needle loop NL, like the weft in-laid yarn. Because the needle loop NL of the fixing chain knitting yarn 14 is formed on the same needle and at the same time, no needle loop NL of the first warp knitting yarn 15*a* is formed, no excessive load is applied to the needle. Further, because a knitting yarn hook space of a front end hook portion of a needle is sufficient, the loop (knitted stitch) can be formed securely without looseness of any knitting yarn.

The second warp knitting yarn 15*b* knitted in between the wale W3 of the third row and the wale W4 of the fourth row adjacent to the side of the tape main body 1*b* forms a needle loop simultaneously by the same needle as the needle loop NL of the foundation chain knitting yarn 12 formed in the wale W4 of the fourth row, and is entangled with the same needle loop NL. The second warp knitting yarn 15*b* which is entangled with the fixing chain knitting yarn 14 of the wale W3 of the third row is not entangled with the needle loop NL of the same fixing chain knitting yarn 14 through its needle loop, but the second warp knitting yarn 15*b* is inserted into between the needle loop NL and the sinker loop SL of the fixing chain knitting yarn 14 like the first warp knitting yarn 15*a* which is knitted between the wale W1 of the first row and the wale W2 of the second row, and thereafter, is wound around the needle loop NL of the fixing chain knitting yarn 14, inverted and entangled.

That is, the second warp knitting yarn 15*b* to be knitted in between the wale W3 of the third row and the wale W4 of the fourth row adjacent to the side of the tape main body 1*b* is entangled with the foundation structure through their needle loops. However, the second warp knitting yarn 15*b* is not entangled with the needle loop of the fixing chain knitting yarn 14, but wound around the needle loop of the fixing chain knitting yarn 14 and inverted without forming any needle loop. As a result, no excessive load is applied to the needle of the fixing chain knitting yarn 14. Because a knitting yarn hook space of the front end hook portion of the needle is sufficient, the fixing chain knitting yarn 14 can form a loop securely (knitted stitch) without loosing out of any needle.

As the composition yarn of the fastener tape of this embodiment, a bulky textured yarn composed of multifilament of polyester or flat yarn having a configuration before texturing treatment is used, and the textured yarn or flat yarn is used as the foundation tricot knitting yarn 11. Its size is 110 to 167T (decitex). The flat yarn is used as the foundation chain knitting yarn 12 and its size is 84 to 110T, which is the smallest of all the composition yarns. As the foundation weft in-laid yarn 13, a textured yarn of 167T is used. Further, a flat yarn of 167T is used as the warp in-laid yarn 16. On the other hand, a flat yarn of 220 to 330T is used as the fixing chain knitting yarn 14, and a flat yarn of 167 to 220T is used as the warp knitting yarn 15.

The fixing chain knitting yarn 14 has a size two or more larger than that of the other foundation warp knitting yarns. If it is intended to form a needle loop NL with the same needle with respect to the fixing chain knitting yarn 14 and other yarn, for example, the reinforcement warp knitting yarn 15, an excessively large load is applied to the same needle, so that the needle is broken. Even if it is not broken, the fixing chain knitting yarn 14 and the warp knitting yarn 15 cannot be caught by the knitting yarn hook space of the front end hook portion of the needle at the same time. Consequently, an either knitting yarn looses out of the front end hook portion, so that a portion in which no needle loop is formed occurs. Here, the weft in-laid yarn 14 and the warp in-laid yarn 16 apply no load on the needle because they do not form any loops. On the other hand, the foundation tricot knitting yarn 11 and the foundation chain knitting yarn 12 which constitute the foundation structure of the fastener tape main body 1*b* form two loops with the same needle at the same time. However, the needle is never broken or any fault such as drop stitch is not generated because the total size of these yarns is 194 to 277T and is smaller than the size of a single fixing chain knitting yarn 14, thereby achieving a high quality product having a high yield. Particularly, because the reinforcement warp knitting yarn 15 and the warp in-laid yarn 16 are knitted into the element attaching portion of this embodiment, an elaborate and massive area whose shape is stabilized is formed, so that the fastener elements E are fixed firmly.

According to the first embodiment, all the warp knitting yarns for use in the slide fastener including synthetic resin monofilament which constitutes the fastener element row ER use a polyester made composition yarn. However, it is also permissible to use yarns of thermoplastic resin, such as polyamide base or polypropylene base. Further, as the composition yarn other than that of the fastener element row ER, it is permissible to use acetate made yarn or natural fibre yarn such as cotton or wool as well as the above-mentioned synthetic resin. These points are the same as for other embodiments described below.

Figure 4:
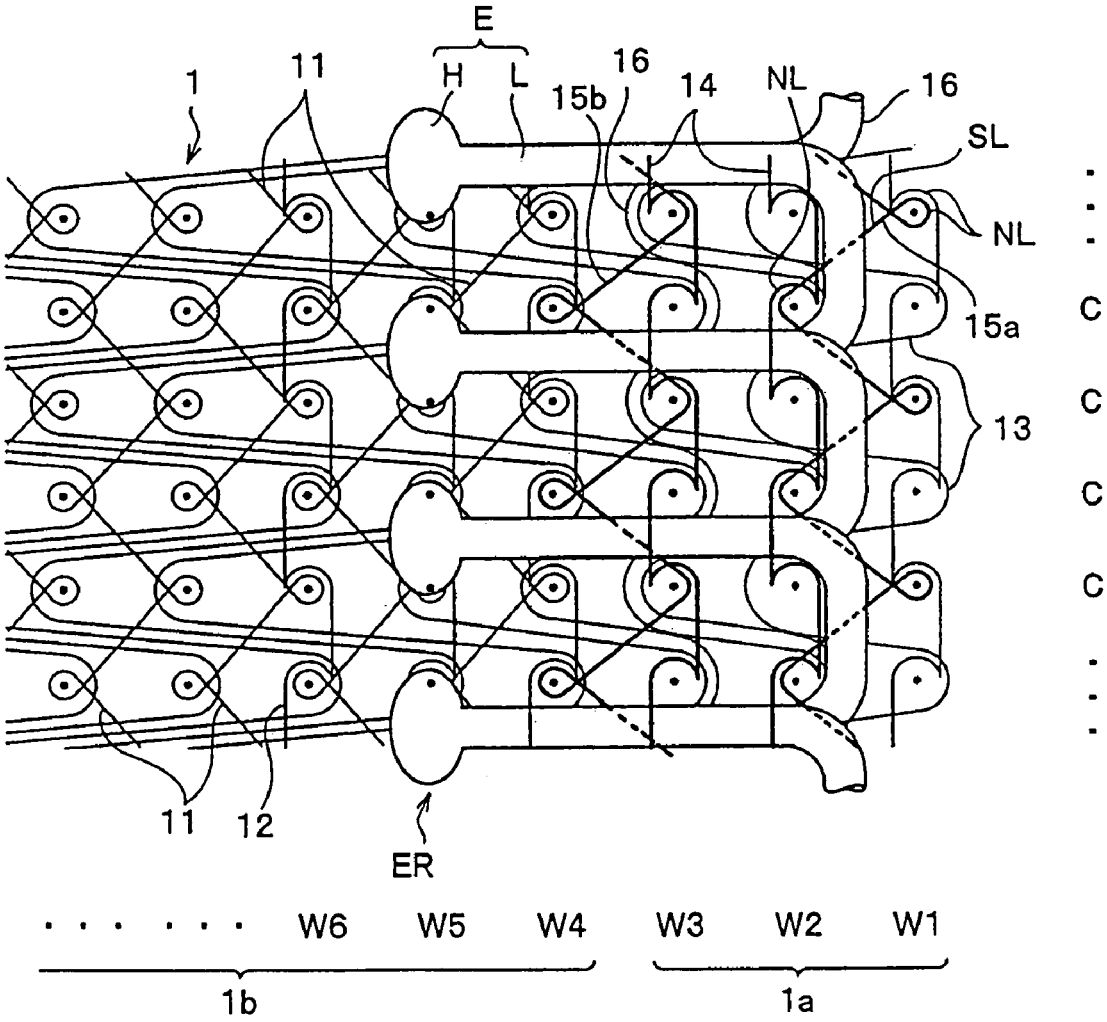
FIG. 4 is a structure view showing an entire warp knitting structure of a warp knitted-in slide fastener according to a second embodiment of the present invention.
Figure 5:
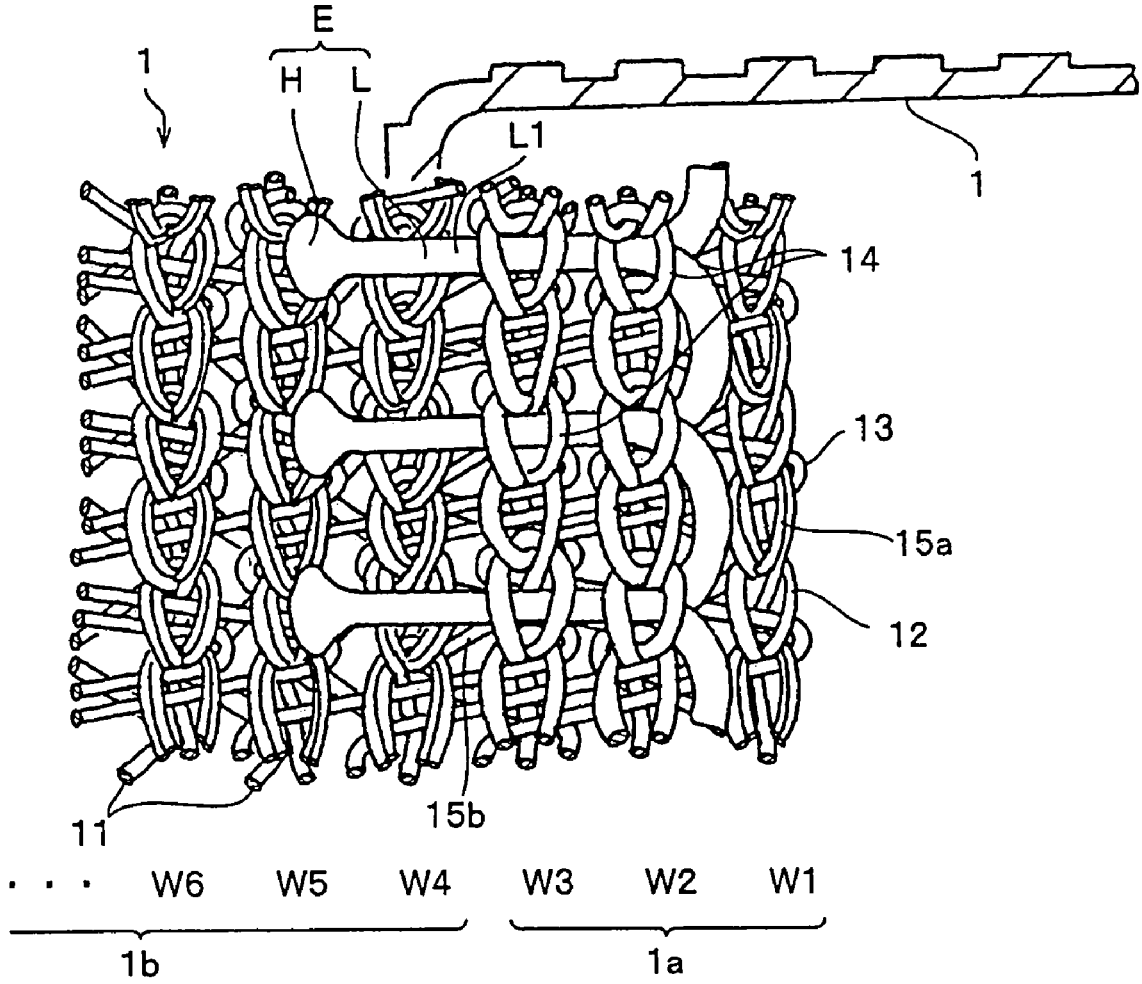
FIG. 5 is a partial plan view schematically showing the slide fastener.

FIG. 4 shows the warp knitting structure view of an entire concealed knitted-in slide fastener according to a second embodiment of the present invention. FIG. 5 is a plan view schematically showing major portions of the same slide fastener. Although in the warp knitting structure of this embodiment, the warp in-laid yarn is inserted in a zigzag shape into each of three wales in the element attaching portion also like the ordinary knitted-in slide fastener, representation of this warp in-laid yarn is omitted.

Because the knitting structure of each knitting yarn of this embodiment is the same as the knitting structure shown in FIG. 2, as understood from these figures, so that the same reference numerals are attached to warp knitting yarns corresponding to the above-described embodiment. That is, the foundation knitting yarn which constitutes the foundation structure of this embodiment is comprised of a foundation tricot knitting yarn 11, a foundation chain knitting yarn 12 and a weft in-laid yarn 13. The continuous coil-like fastener element row ER, the weft in-laid yarn 13, the fixing chain knitting yarn 14, the reinforcement warp knitting yarn 15 (15*a*, 15*b*) and the warp in-laid yarn 16 are knitted into the element attaching portion 1*a* with excluding the foundation tricot knitting yarn 11 and the foundation chain knitting yarn 12.

A large difference between the concealed slide fastener and an ordinary slide fastener exists in that in the ordinary knitted-in slide fastener, engaging heads H of the fastener elements E mounted on the element attaching portion 1*a* of one side edge in the longitudinal direction of the fastener tape 1 are attached such that they protrude outward from the side edge as shown in FIGS. 1 and 3, while in case of the concealed slide fastener, the engaging heads H of the fastener elements E mounted on the element attaching portion 1*a* are attached such that they protrude toward a fastener tape main body side from a border between the element attaching portion 1*a* and the fastener tape main body 1*b* in an opposite direction to the ordinary slide fastener. Then, the concealed slide fastener is bent into a U-shape along the border of the fastener stringer on which the fastener elements E are mounted as described above such that the fastener element row ER is located outside, and its configuration is fixed. As mentioned above, this embodiment is not different from the first embodiment in the warp knitting structure except for the concealed structure, and its operation and effect are not different except its well-known function as the concealed structure.

Figure 6:
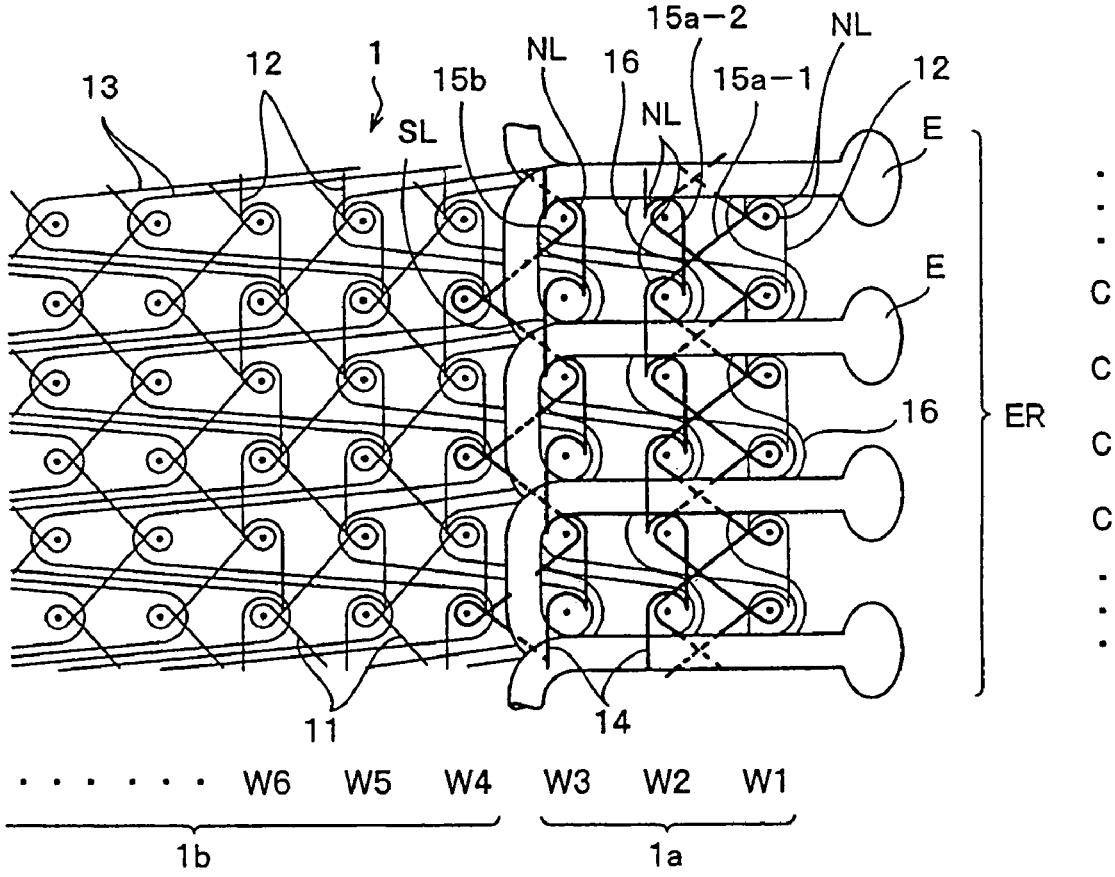
FIG. 6 is a structure view showing an entire warp knitting structure of a warp knitted-in slide fastener according to a third embodiment of the present invention.

FIG. 6 shows a third embodiment of the present invention. The third embodiment is largely different from the first embodiment shown in FIG. 2 in that two warp knitting yarns 15*a*-1, 15*a*-2 are used as the first warp knitting yarn 15*a* knitted in between a wale W1 of the first row formed on the outermost side in the element attaching portion 1*a* and a wale W2 of the second row adjacent to the wale W1, and that the needle loops NL of the warp knitting yarns 15*a*-1, 15*a*-2 are entangled with all needle loops NL formed in each course of the foundation chain knitting yarn 12 of the wale W1 of the first row. Each of the reinforcement warp knitting yarns 15*a*-1, 15*a*-2 has the same knitting structure as that of the first warp knitting yarn 15*a* in the first embodiment, and each of them is knitted in a zigzag shape into the wales W1, W2 of the first and second rows skipping every other course.

Adoption of such a structure blocks the needle from an excessive load at the time of knitting of the fixing chain knitting yarn 14 and further, the wales W1, W2 on the outer side edge of the element attaching portion 1*a* becomes more thickly than the knitted-in slide fastener obtained by the first and second embodiments, and particularly, all the needle loops NL of the fixing chain knitting yarn 14 knitted into the wale W2 of the second row are entangled with the first warp knitting yarns 15*a*-1, 15*a*-2. Accordingly, the tightening force on the fastener elements E by the fixing chain knitting yarn 14 increases, so that they are fixed to the fastener tape 1 firmly. As a consequence, the tape configuration is stabilized and smooth engagement of the fastener elements is achieved, thereby preventing disengagement of the elements and lateral slide between the elements.

In the meantime, according to the first to third embodiments, all the reinforcement warp knitting yarns 15, 15*a*, 15*b*, 15*a*-1, 15*a*-2 form the needle loop NL for at least every other course. However, according to the fourth and fifth embodiments shown in FIGS. 7 and 8 of the present invention, one warp knitting yarn 15*c* of the reinforcement warp knitting yarns knitted in the zigzag shape into plural wales formed by the fixing chain knitting yarn 14 in the element attaching portion does not form any needle loops NL, and is knitted as the weft in-laid yarn which is just folded back at the needle loop NL of the fixing chain knitting yarn 14.

Figure 7:
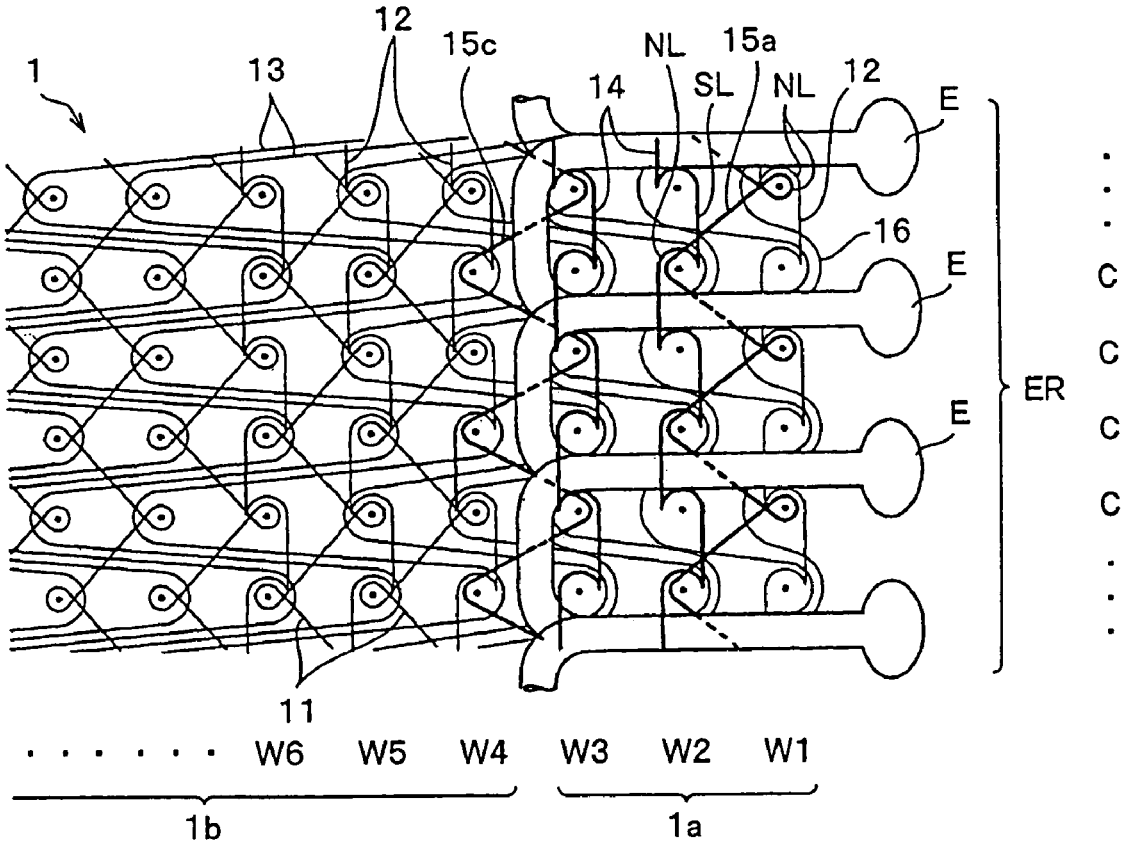
FIG. 7 is a structure view showing an entire warp knitting structure of a warp knitted-in slide fastener according to a fourth embodiment of the present invention.
Figure 8:
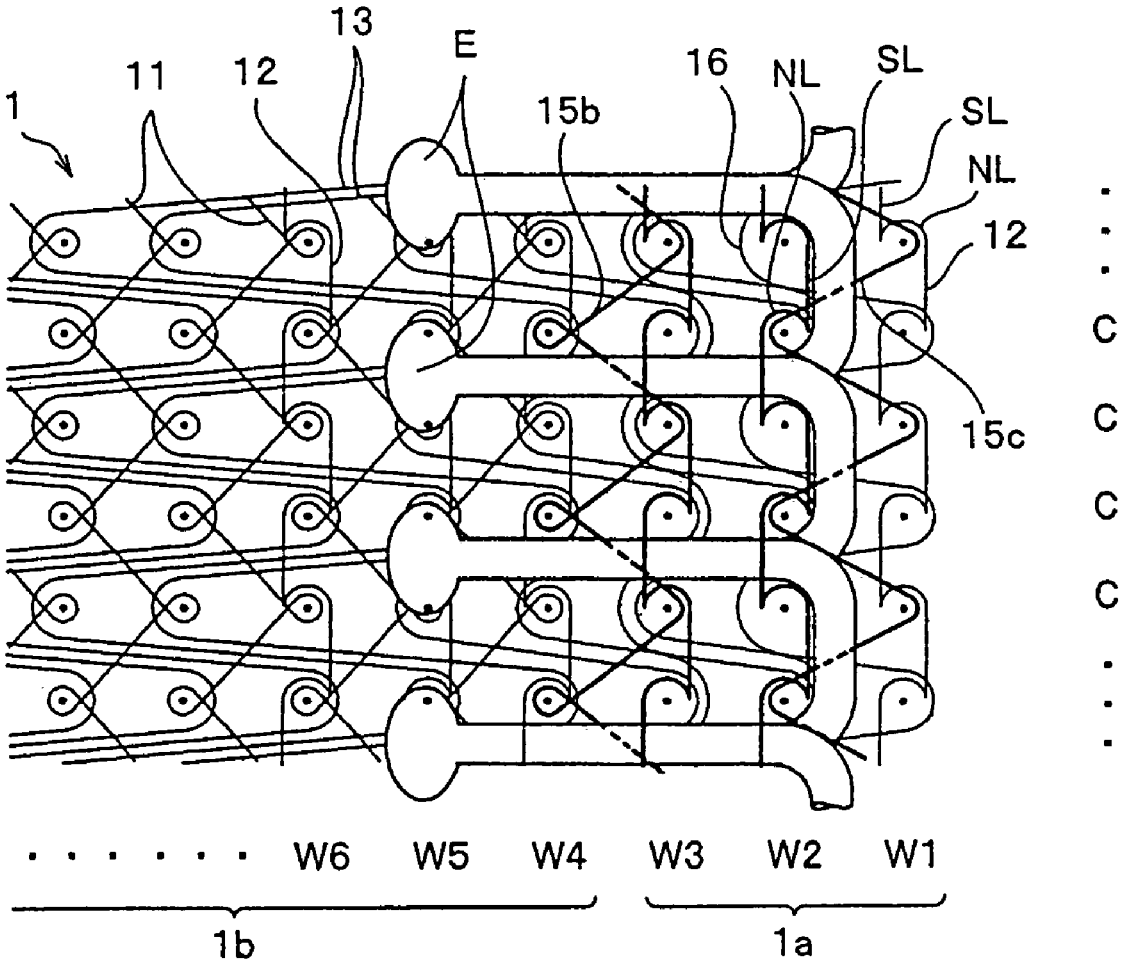
FIG. 8 is a structure view showing an entire warp knitting structure of a warp knitted-in slide fastener according to a fifth embodiment of the present invention.

FIGS. 7 and 8 show an ordinary knitted-in slide fastener and a knitted-in slide fastener having the concealed structure. According to the fourth embodiment shown in FIG. 7, the third warp knitting yarn 15*c* (0-0/2-2) for reinforcement knitted in between the wale W3 of the third row and the wale W4 of the fourth row adopts the weft in-laid structure and forms no needle loop NL as described above. Further, in this fourth embodiment, the warp in-laid yarn 16 is inserted into each of the wales W1 to W3 of the first to third rows. On the other hand, according to the fifth embodiment shown in FIG. 8, the third warp knitting yarn 15*c* knitted in between the wale W1 of the first row and the wale W2 of the second row is knitted with the weft in-laid structure, and forms no needle loop NL as described above. According to the fifth embodiment, the warp in-laid yarn 16 is inserted in each of the wale W2 of the second row and the wale W3 of the third row in which the fixing chain knitting yarn 14 is to be knitted.

As evident from the above description, it is important that at least one reinforcement warp knitting yarn knitted in between the foundation knitting yarn and the fixing chain knitting yarn in plural wales adjacent to the fixing chain knitting yarn is entangled with the needle loop of the foundation knitting yarn through its needle loop NL, although all the reinforcement warp knitting yarns do not need to form any loop. Although the above embodiment uses the tricot knitting yarn as one of yarns constituting the foundation structure, the two needle stitch yarn may be adopted instead of the aforementioned tricot knitting yarn 11. According to the above embodiment, the quantity of wales in which the fixing chain knitting yarn is knitted into an element attaching portion thereof is two, but it may be three. Although the above embodiment picks up an example that the needle loop NL is formed in the form of a closed loop, it does not always need to be of closed loop but may be of open loop.

What is claimed is:

1. A knitted-in slide fastener in which at the same time when a fastener tape is knitted, a continuous fastener element row is fixed and knitted, by a fixing chain knitting yarn, into a fastener element attaching portion of a side edge in a longitudinal direction of a warp knitted fastener tape knitted with a foundation structure composed of warp knitting yarns, wherein the knitted-in slide fastener includes other warp knitting yarns, and said other warp knitting yarns are entangled to a needle loop of a foundation warp knitting yarn, which is formed in at least one of wales of the foundation structure being adjacent to a wale of the fastener element attaching portion formed by the fixing chain knitting yarn, with a needle loop, and said other warp knitting yarns are turned back through a sinker loop of the fixing chain knitting yarn formed in the wale of the fastener element attaching portion.

2. The knitted-in slide fastener according to claim 1, wherein said other warp knitting yams are turned back, with respect to the sinker loop of the fixing chain knitting yarn, such that they are inserted through the sinker loop being adjacent in a wale direction of the needle loop of the fixing chain knitting yam so as to go around the needle loop of the fixing chain knitting yarn.

* * * * *